US009880496B2

(12) United States Patent
Ono

(10) Patent No.: US 9,880,496 B2
(45) **Date of Patent: *Jan. 30, 2018**

(54) TRANSFER ROLLER, PROCESS CARTRIDGE, AND IMAGE FORMING APPARATUS

(71) Applicant: FUJI XEROX CO., LTD., Tokyo (JP)

(72) Inventor: Masato Ono, Ebina (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/257,465

(22) Filed: Sep. 6, 2016

(65) Prior Publication Data

US 2017/0277081 A1 Sep. 28, 2017

(30) Foreign Application Priority Data

Mar. 28, 2016 (JP) ..... 2016-064651

(51) Int. Cl.
*G03G 15/16* (2006.01)

(52) U.S. Cl.
CPC ..... *G03G 15/162* (2013.01)

(58) Field of Classification Search
None
See application file for complete search history.

(56) References Cited

U.S. PATENT DOCUMENTS 9,482,996 B1 * 11/2016 Ono ..... G03G 15/1685
2001/0018000 A1 * 8/2001 Hirai ..... G03G 15/0131 399/299
2008/0057289 A1 * 3/2008 Ichikawa ..... B32B 5/18 428/304.4
2012/0219333 A1 * 8/2012 Namba ..... G03G 15/1675 399/313
2012/0322637 A1 * 12/2012 Takano ..... C08J 9/0066 492/56
2014/0363178 A1 * 12/2014 Hatori ..... G03G 21/0094 399/24

FOREIGN PATENT DOCUMENTS

JP 2010-164821 A 7/2010

* cited by examiner

*Primary Examiner* — Thomas Giampaolo, II
(74) *Attorney, Agent, or Firm* — Oliff PLC

(57) ABSTRACT

A transfer roller is provided and includes a support body, a foaming elastic layer that is disposed on an outer circumferential surface of the support body, and a surface resin layer that contains polyimide or polyamide-imide and covers an outer circumferential surface of the foaming elastic layer, in which circumferential lengths of both end portions of the surface resin layer in a roller axial direction is shorter than that of a center portion of the surface resin layer in the roller axial direction.

4 Claims, 2 Drawing Sheets

TRANSFER ROLLER, PROCESS CARTRIDGE, AND IMAGE FORMING APPARATUS

CROSS-REFERENCE TO RELATED APPLICATIONS

This application is based on and claims priority under 35 USC 119 from Japanese Patent Application No. 2016-064651 filed Mar. 28, 2016.

BACKGROUND (i) Technical Field

The invention relates to a transfer roller, a process cartridge, and an image forming apparatus.

(ii) Related Art

An image forming apparatus using an electrophotographic system forms charges on a surface of an image carrier such as a photoreceptor by using an exposure device, forms an electrostatic latent image by using a laser beam modulated with an image signal, then develops the electrostatic latent image with charged toners to form a visualized toner image, and directly transfers the toner image to a recording medium or transfer the toner image to the recording medium via an intermediate transfer body.

For example, in a case of an intermediate transfer method, the toner image formed on the surface of the image carrier is primarily transferred to a surface (an outer circumferential surface) of an intermediate transfer belt in an electrostatic manner, then is secondarily transferred to the recording medium such as a recording sheet in an electrostatic manner, and then is heated and pressurized in a fixing device so as to be fixed on the recording medium.

As a transfer roller for transferring the toner image on the image carrier to the recording medium or transfers the toner image to the intermediate transfer belt, or as a transfer roller for transferring the toner image on the intermediate transfer belt to the recording medium, various conductive rollers have been developed.

SUMMARY

According to an aspect of the invention, a transfer roller includes a support body, a foaming elastic layer that is disposed on an outer circumferential surface of the support body, and a surface resin layer that contains polyimide or polyamide-imide and covers an outer circumferential surface of the foaming elastic layer, in which circumferential lengths of both end portions of the surface resin layer in a roller axial direction is shorter than that of a center portion of the surface resin layer in the roller axial direction.

BRIEF DESCRIPTION OF THE DRAWINGS

Exemplary embodiments of the present invention will be described in detail based on the following figures, wherein.

DETAILED DESCRIPTION

Figure 1:
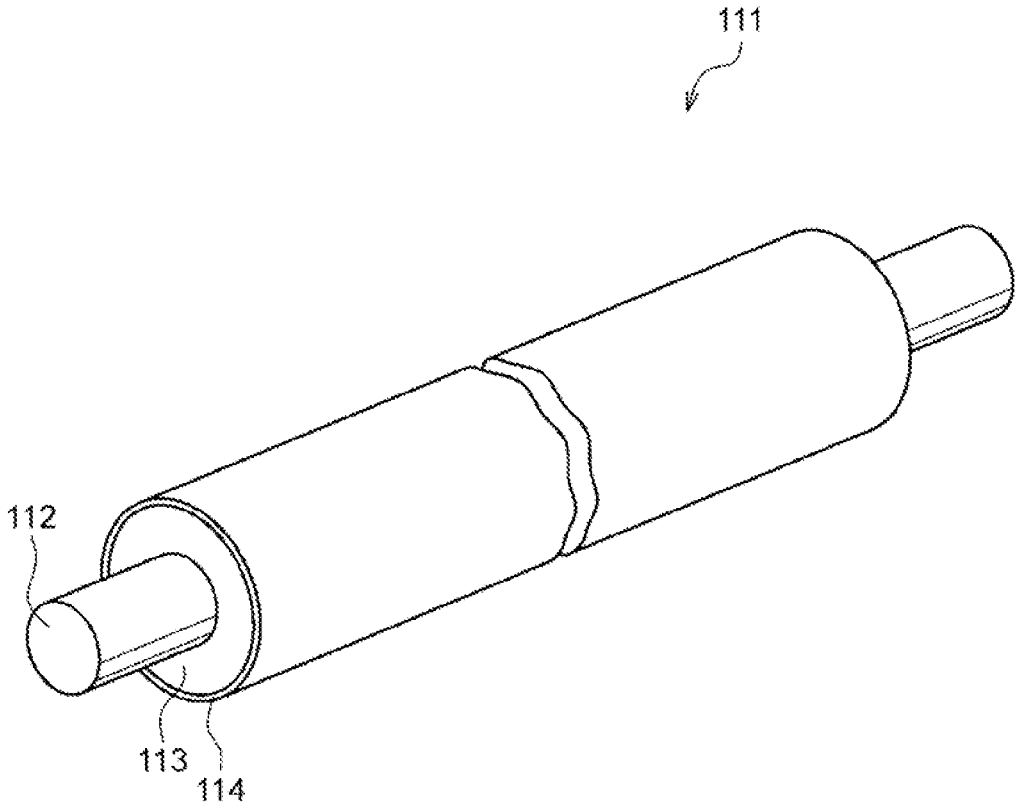
FIG. 1 is a schematic perspective diagram illustrating one example of a transfer roller according to the exemplary embodiment.

Hereinafter, an example of exemplary embodiments will be described with reference to the drawings. Members having common functions and actions are denoted by the same reference numerals in the drawings, and the repeated description may be omitted.

Transfer Roll

The transfer roller according to the exemplary embodiment includes a support body, a foaming elastic layer which is disposed on the outer circumferential surface of the support body, and a surface resin layer which covers the outer circumferential surface of the foaming elastic layer. The surface resin layer contains polyimide or polyamide-imide. Circumferential lengths of at both end portions of the surface resin layer in the roller axial direction (hereinafter, simply referred to as "both end portions") is smaller than that of a center portion of the surface resin layer in the roller axial direction (hereinafter, simply referred to as "the center portion").

Figure 2:
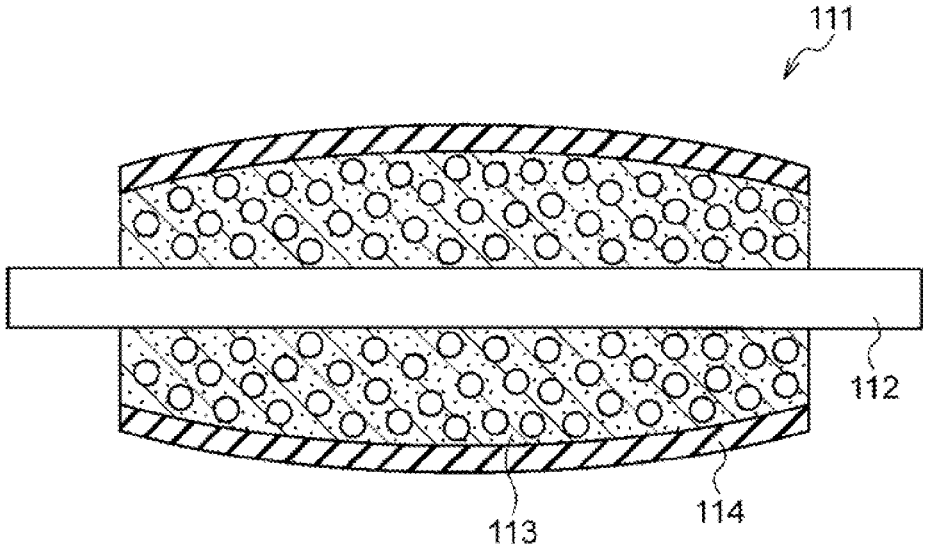
FIG. 2 is a diagram schematically illustrating a cross-section of the transfer roller in an axial direction according to the exemplary embodiment.

FIG. 1 schematically illustrates an example of the transfer roller according to the exemplary embodiment. FIG. 2 schematically illustrates a cross-section of the transfer roller in the axial direction according to the exemplary embodiment.

As illustrated in FIG. 1, a transfer roller 111 according to the exemplary embodiment is a rolling member which includes, for example, a cylindrical or columnar support body 112 (a shaft), a foaming elastic layer 113 provided on an outer circumferential surface of the support body 112, and a surface resin layer 114 provided on an outer circumferential surface of the foaming elastic layer 113. The surface resin layer 114 of the transfer roller 111 according to the exemplary embodiment contains polyimide or polyamide-imide, and is a cylindrical body (a resin tube) which includes both end portions each having a circumferential length which is shorter than the circumferential length of the center portion, and covers the outer circumferential surface of the roller-shaped foaming elastic layer 113.

The occurrence of transfer unevenness of toner images is prevented by using the transfer roller 111 according to the exemplary embodiment which is configured as described above. The reason for this is presumed as follows.

In the transfer roller which is used for the image forming apparatus using an electrophotographic system, rollers are disposed to face each other with respect to a transfer and a supporting member (a shaft) is bent at the time of being nipped, that is, at the time of receiving a road from a facing member such as an image carrier, and thus the load distribution is generated in the roller axial direction, thereby causing the transfer unevenness and a cleaning defect in the roller axial direction.

For example, a toner attached on the outer circumferential surface of the transfer roller prevents the recording medium front being re-transferred, and thus the transfer roller requires cleaning performance. Examples of a unit that improves the cleaning performance of the transfer roller include a unit that covers the foaming elastic layer with a tubular member (a resin tube) formed of a resin. However, it is considered that when the foaming elastic layer having the constant outer diameter (having a straight shape) in the roller axial direction is covered with the resin tube (cylindrical body), and loads on a nip portion (nip loads) at the time of transferring the toner image to the recording medium concentrates the end portion, a distribution of the nip loads becomes large in the roller axial direction, and the uniformity of transfer currents is deteriorated, which thus causes the transfer unevenness.

On the other hand, the transfer roller 111 according to the exemplary embodiment is configured such that the outer circumferential surface of the foaming elastic layer 113 is covered with the surface resin layer 114 which has such a shape (crown shape) that the circumferential lengths of the both end portions is shorter than that of the center portion. Thus, the outer circumferential shape of the transfer roller 111 is also a crown shape. As a result, the nip loads are not easily applied to the both end portions, but are easily applied to the center portion. For this reason, the nip loads are uniformly distributed in the roller axial direction, and thus the transfer roller 111 according to the exemplary embodiment contributes to an excellent image which is formed such that transfer currents are highly uniformed in the axial direction, and the transfer unevenness and density unevenness of the toner images are prevented.

In addition, it is considered that the surface resin layer 114 containing polyimide or polyamide-imide is less likely to be deformed by a repulsive force from the foaming elastic layer, has high cleaning performance, and contributes to stable and excellent image quality even when being used for a long period of time.

Hereinafter, the transfer roller according to the exemplary embodiment will be further described in detail.

Support Body

The support body 112 is a member serves as an electrode and a supporting member of the rolling member.

Examples of the support body 112 include metal members such as iron (free-cutting steel and the like), copper, brass, stainless steel, aluminum, and nickel.

Examples of the support body 112 include a member which is subjected to a plating treatment on the outside of the plane (for example, a resin or a ceramic member), and a member in which the conductive agent is distributed (for example, a resin or a ceramic member).

The support body 112 may be a hollow member (cylindrical member), or a non-hollow member.

Foaming Elastic Layer

The foaming elastic layer 113 is cylindrically disposed on the outer circumferential surface of the support body 112.

The foaming elastic layer 113 contains, for example, a rubber material (elastic material) and a foaming agent, and a conductive agent and other additives as necessary.

Examples of the rubber material (the elastic material) include a so-called elastic material having at least a double bond in the chemical structure.

Specifically, examples of the rubber material include isoprene rubber, chloroprene rubber, epichlorohydrin rubber (ECO), butyl rubber, polyurethane, silicone rubber, fluororubber, styrene-butadiene rubber, butadiene rubber, nitrite rubber, ethylene-propylene rubber, epichlorohydrin-ethylene oxide copolymer rubber, epichlorohydrin-ethylene oxide-allyl glycidyl ether copolymer rubber, ethylene-propylene-diene terpolymer rubber (EPDM), acrylonitrile-butadiene copolymer rubber (NBR), and natural rubber, and rubber in combination with the above-described rubber materials.

Among the above-described rubber materials, polyurethane, ECO, EPDM, epichlorohydrin-ethylene oxide copolymer rubber, epichlorohydrin-ethylene oxide-allyl glycidyl ether copolymer rubber, NBR, and rubber in combination with the above-described rubber materials are preferably used.

Examples of the foaming agent include benzene sulfonyl hydrazide, azodicarbonamide (ADCA), N, N'-dinitrosopentamethylene tetramine, dinitroso pentamethylene tetramine (DPT), dinitrosopenta styrene tetramine and benzene sulfonyl hydrazide derivatives, oxy bisbenzene sulfonyl hydrazide (OBSH), ammonium bicarbonate which generates carbon dioxide, sodium bicarbonate, ammonium carbonate, nitroso sulfonyl azo compound which generates nitrogen, N,N'-dimethyl-N, N'-dinitroso phthalic amide, toluenesulfonyl hydrazide, P-toluenesulfonyl semicarbazide, and P,P'-oxo-bis(benzene sulfonyl semicarbazide).

Among the above-described foaming agents, in consideration of ease of foam control, benzene sulfonyl hydrazide, and azodicarbonamide are preferably used.

The foaming agent may be used alone or two or more types thereof may be used in combination.

The formation of the foaming agent is not particularly limited, and may be optionally formed into a powder form, a liquid form, and a capsule form in accordance with the purpose.

The conductive agent is used in cases where the conductivity of the rubber material is low and the rubber material does not have the conductivity, as necessary. Examples of the conductive agent include an electronic conductive agent and an ion conductive agent.

Examples of the electronic conductive agent include powders of carbon black such as Ketjen black and acetylene black; pyrolytic carbon, graphite; various types of conductive metal such as aluminum, copper, nickel, and stainless steel, or an alloy; various types of conductive metal oxides such as tin oxide, iridium oxide, titanium oxide, a tin oxide-antimony oxide solid solution, and a tin oxide-indium oxide solid solution; and a substance obtained by performing an electro-conductive treatment on the surface of the insulating material.

Here, specific examples of the carbon black include "special black 350", "special black 100", "special black 250", "special black 5", "special black 4", "special black 4A", "special black 550", "special black 6", "color black FW200", "color black FW2", and "color black FW2V" which are manufactured by Orion Engineered Carbons, and "MONARCH1000", "MONARCH1300", "MONARCH1400", "MOGUL-L", and "REGAL 400R" which are manufactured by Cabot Corporation.

The electronic conductive agent may be used alone or two or more types thereof may be used in combination.

The content of the electronic conductive agent may be, for example, in a range of 1 part by weight to 30 parts by weight, and is preferably in a range of 15 parts by weight to 25 parts by weight, with respect to 100 parts by weight of the rubber material.

Examples of the ion conductive agent include quaternary ammonium salt (for example, perchlorate such as lauryl trimethyl ammonium, stearal trimethyl ammonium, octadodecyl trimethyl ammonium, dodecyl trimethyl ammonium, hexadecyl trimethyl ammonium, and modified fatty acid dimethyl ethyl ammonium, chlorate, fluoroboric acid salt, sulfate, ethosulfate salt, and benzyl halide salt (for example, benzyl bromide salt and benzyl chloride salt)), aliphatic sulfonic acid salts, higher alcohol sulfuric ester salts, higher alcohol ethylene oxide addition sulfuric acid ester salts, higher alcohol phosphate ester salts, higher alcohol ethylene oxide addition phosphoric acid ester salts, various betaine, higher alcohol ethylene oxide, polyethylene glycol fatty acid esters, and polyhydric alcohol fatty acid ester.

The ion conductive agent may be used alone or two or more types thereof may be used in combination.

The content of the ion conductive agent is, for example, in a range of 0.1 parts by weight to 5.0 parts by weight, and is preferably in a range of 0.5 parts by weight to 3.0 parts by weight, with respect to the rubber material 100 parts by weight.

Examples of other additives include materials such as a foaming aid, a softening agent, a plasticizer, a curing agent, a vulcanizing agent, a vulcanization accelerator, an antioxidant, a surfactant, a coupling agent, and a filler (silica, calcium carbonate, and the like) which are added to the normal elastic layer.

A common logarithm value of the volume resistivity of the foaming elastic layer 113 is preferably in a range of 6 (Log Ω·cm) to 8 (Log Ω·cm), and is further preferably in a range of 6.5 (Log Ω·cm) to 7.5 (Log Ω·cm), in terms of the image quality. The volume resistivity of the foaming elastic layer 113 is adjusted by types and amounts of the conductive agents to be mixed.

The thickness of the foaming elastic layer 113 is, for example, in a range of 2 mm to 20 mm, and is preferably in a range of 2 mm to 15 mm. If the thickness of the foaming elastic layer 113 is equal to or greater than 2 mm, the thickness of the layer is thin enough to sufficiently prevent the occurrence of leak, and if the thickness of the foaming elastic layer 113 is equal to or less than is 15 mm, it is not excessively deformed in vulcanizing and foaming steps during the manufacturing process, and thus the crack of the layer is effectively prevented.

Examples of the outer circumferential shape of the foaming elastic layer 113 before the outer circumferential surface of the foaming elastic layer 113 is covered with the surface resin layer 114 has such a shape that the outer diameter is constant (the straight shape) in the roller axial direction or such a shape (the crown shape) that the outer diameter of the center portion is larger than those of the both end portions in the roller axial direction.

In a case where the outer circumferential shape of the foaming elastic layer 113 before being covered with the surface resin layer 114 is the straight shape, when the foaming elastic layer 113 is covered with the crown-shaped surface resin layer 114, the loads are more easily applied to the both end portions than the center portion of the foaming elastic layer 113 due to the surface resin layer 114. On the other hand, in a case where the outer circumferential shape of the foaming elastic layer 113 is the crown shape, the uniformity of the loads applied to the foaming elastic layer 113 by the crown-shaped surface resin layer 114 is likely to high in the entire roller axial direction, and the nip loads having more higher uniformity in the roller axial direction are easily obtained. In order to achieve the high uniformity of the nip loads in the roller axial direction, the outer circumferential shape of the foaming elastic layer 113 which is not covered with the surface resin layer 114 is preferably the same crown shape as that of the surface resin layer 114.

In the exemplary embodiment, in a case where the length of the foaming elastic layer 113 in the roller axial direction is 100%, the center portion of the foaming elastic layer 113 in the roller axial direction means a portion in a width range of 20% from the center point between both end terminals (end surfaces), and the both end portions of the foaming elastic layer 113 in the roller axial direction mean portions in a width range of 10% toward the center portion from the terminals (end surfaces) of the foaming elastic layer 113. The same is true for the center portion and the both end portions of the surface resin layer 114 in the roller axial direction.

Surface Resin Layer

The surface resin layer 114 contains polyimide or polyamide-imide and covers the outer circumferential surface of the foaming elastic layer 113. The circumferential lengths of the both end portions are shorter than that of the center portion.

For example, in a case where a tetralluoroethvlene perfluoroalkyl vinyl ether copolymer (PFA) tube is used as the surface resin layer, toner attachment is prevented, and thus high cleaning performance is obtained; however, the PFA tube is flexible, and in a case where the outer circumferential surface of the foaming elastic layer 113 is covered with the PFA tube, the PFA tube is easily deformed by the repulsive force of the foaming elastic layer 113.

On the other hand, the surface resin layer 114 in the exemplary embodiment contains polyimide or polyamide-imide, and thus has strong strength, thereby preventing the surface resin layer 114 from being extended even when the repulsive force is applied from the foaming elastic layer 113.

As a resin material contained in the surface resin layer 114, polyimide is particularly preferable in terms of strength, heat resistance, and dimensional stability.

The surface resin layer 114 may contain other resins in addition to polyimide or polyamide-imide; however, among the resins contained in the surface resin layer 114, the resin having the most large content amount of polyimide or polyamide-imide is preferably used, and the resin having polyimide or polyamide-imide which is equal to or greater than 50% by weight is further preferably used.

The thickness of the surface resin layer 114 is, for example, in a range of 0.02 mm to 0.2 mm, and is preferably in a range of 0.02 mm to 0.1 mm. If the thickness of the surface resin layer 114 is equal to or greater than 0.02 mm, the crack of the layer or the like is less likely to occur even when the repulsive force is applied from the inside of the foaming elastic layer, and a metal blade is prevented from being turned up at the time of cleaning the surface. The thickness of the surface resin layer 114 is measured by using an eddy current type film thickness meter (MP30 manufactured by Fischer Instruments K.K).

The surface resin layer l14 may include a conductive agent.

Examples of the conductive agent contained in the surface resin layer 114 include an electronic conductive agent and an ion conductive agent.

Examples of the electronic conductive agent include powders of carbon black such as Ketjen black and acetylene black; pyrolytic carbon, graphite; various types of conductive metal such as aluminum, copper, nickel, and stainless steel, or an alloy; various types of conductive metal oxides such as tin oxide, indium oxide, titanium oxide, a tin oxide-antimony oxide solid solution, and a tin oxide-indium oxide solid solution; and a substance obtained by performing an electro-conductive treatment on the surface of the insulating material.

Here, specific examples of the carbon black include "special black 350", "special black 100", "special black 250", "special black 5", "special black 4", "special black 4A", "special black 550", "special black 6", "color black FW200", "color black FW2", and "color black FW2V" which are manufactured by Orion Engineered Carbons, and "MONARCH1000", "MONARCH1300", "MONARCH1400", "MOGUL-L", and "REGAL 400R" which are manufactured by Cabot Corporation.

The electronic conductive agent may be used alone or two or more types thereof may be used in combination.

Examples of the ion conductive agent include quaternary ammonium salt (for example, perchlorate such as lauryl trimethyl ammonium, stearyl trimethyl ammonium, octadodecyl trimethyl ammonium, dodecyl trimethyl ammonium, hexadecyl trimethyl ammonium, and modified fatty acid dimethyl ethyl ammonium, chlorate, fluoroboric acid salt, sulfate, ethosulfate salt, and benzyl halide salt (for example, benzyl bromide salt and benzyl chloride salt)), aliphatic sulfonic acid salts, higher alcohol sulfuric ester salts, higher alcohol ethylene oxide addition sulfuric acid ester salts, higher alcohol phosphate ester salts, higher alcohol ethylene oxide addition phosphoric acid ester salts, various betaine, higher alcohol ethylene oxide, polyethylene glycol fatty acid esters, and polyhydric alcohol fatty acid ester.

The ion conductive agent may be used alone or two or more types thereof may be used in combination.

A surface resin layer in which the polyimide is set as a main component (in which the, content of polyimide in the surface resin layer is greater than 50% by weight), and conductive particles such as carbon black are dispersed as the conductive agent is excellent in the mechanical strength and elastic modulus, and thus is particularly preferably used as the surface resin layer 114.

In the transfer roller 111 according to the exemplary embodiment, the outer circumferential surface of the foaming elastic layer 113 is covered with the crown-shaped surface resin layer 114, and thus the uniformity of the nip loads becomes higher in the roller axial direction, thereby preventing the density unevenness of the toner image.

When a difference ΔD (=D1−D2) between an outer diameter D1 of the center portion of the surface resin layer 114 and an outer diameter D2 of each of the both end portions is excessively small, the nip loads on the both end portions increase as compared with the center portion; whereas when the ΔD is excessively large, the nip loads on the both end portions decrease as compared with the center portion. In order to achieve the high uniformity of the nip loads in the roller axial direction, the difference ΔD between the outer diameter D1 of the center portion of the surface resin layer 114 and the outer diameter D2 of each of the both end portions is preferably in a range of 25 μm to 250 μm, is further preferably in a range of 50 μm to 200 μm, and is particularly preferably in a range of 75 μm to 150 μm.

Method of Mannfacturing of Transfer Roller

Next, the method of manufacturing of a transfer roller 111 according to the exemplary embodiment will be described.

A method of manufacturing the transfer roller according to the exemplary embodiment is not particularly limited, for example, the foaming elastic layer is formed by using a method performed in such a manner that a rubber composition which contains an elastic material, a foaming agent, and an additive such as a conductive agent as necessary is put into a press extruder, a cylindrical rubber composition layer is extruded so as to be molded on an outer circumferential surface of a cylindrical or columnar core metal (the support body), and then the molded cylindrical rubber composition layer is subjected to vulcanizing and foaming by heat so as to form a foaming elastic layer.

The outer circumferential of the foaming elastic layer may be molded into the straight shape or the crown shape by being subjected to a polishing process by using of a sandpaper after vulcanizing and foaming the rubber composition layer which is cylindrically formed on the outer circumferential surface of the core.

On the other hand, a method of forming the surface resin layer is performed, for example, in such a manner that the cylindrical core is coated with a coating solution containing polyimide or polyamide-imide. Examples of the coating method include a spiral coating method. In a case where such a surface resin layer is manufactured, the surface resin layer (the resin tube) having such a shape (the crown shape) that the circumferential lengths of the both end portions are shorter than that of the center portion is manufactured.

For example, two types of polyimide precursor solutions which have different shrinkage rates at the time of sintering are prepared. First, an outer circumferential surface of a cylindrical mold is coated with the first polyimide precursor solution which has the relatively large shrinkage rate at the time of sintering, dried, and sintered so as to form a first polyimide layer, and then the surface of the first polyimide layer is coated with the second polyimide precursor solution which has the relatively small shrinkage rate at the time of sintering, dried, and sintered so as to form a second polyimide layer, Since the shrinkage rate of the outer circumferential surface side (the outermost surface side) is smaller than the shrinkage rate of the inner circumferential surface side (which is in contact with the foaming elastic layer), it is possible to manufacture a crown-shaped polyimide tube in which the outer diameters (circumferential lengths) of the both end portions in the width direction (roller axial direction) are smaller than the outer diameter (circumferential length) of the center portion.

In addition, the transfer roller is obtained by covering the foaming elastic layer which is formed on the outer circumferential surface of the support body with the surface resin layer (the resin tube).

Figure 3:
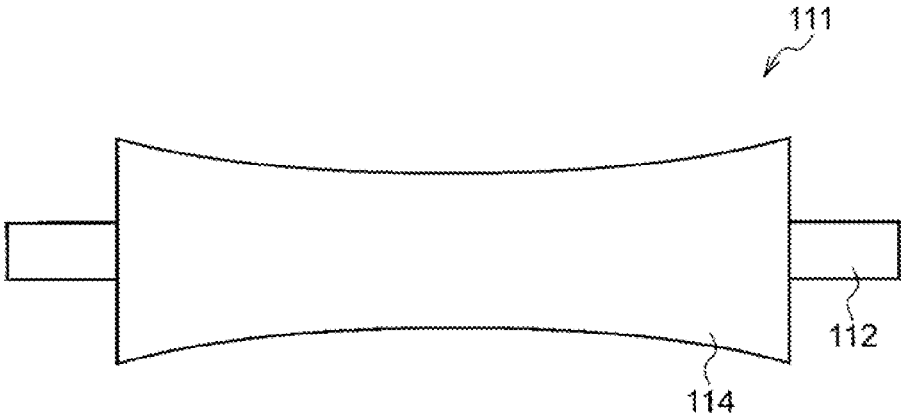
FIG. 3 is a diagram schematically illustrating an outer circumferential shape of a nip portion of the transfer roller as illustrated in FIG. 2.

FIG. 3 is a diagram schematically illustrating an outer circumferential shape of the nip portion of the transfer roller.

The transfer roller 111 according to the exemplary embodiment includes the foaming elastic layer 113 which is covered with the crown-shaped surface resin layer 114. Thus, the outer circumferential shape of the transfer roller 111 is the crown shape as illustrated in FIG. 2. However, when the loads are applied to the facing members from the both end portions of the support body 112, the repulsive force from the both end portions of the foaming elastic layer 113 is small, and the nip portion such has a shape (flare shape) that the outer diameter (the circumferential length) of the center portion as illustrated in FIG. 3 is smaller than the outer diameters (the circumferential lengths) of the both end portions. As a result, it is possible to obtain the nip loads having more higher uniformity in the roller axial direction.

The transfer roller 111 according to the exemplary embodiment is not limited to the above configuration. For example, the transfer roller 111 may be configured such that an intermediate layer such as an adhesion layer between the support body 112 and the foaming elastic layer 113, or between the foaming elastic layer 113 and the surface resin layer 114 is additionally included in the transfer roller 111 having the configuration illustrated in FIG. 1. In addition, the transfer roller 111 may be configured to include a resistance controlling layer or a migration-preventing layer between the foaming elastic layer 113 and the surface resin layer 114.

Image Forming Apparatus and Process Cartridge

The image forming apparatus according to the exemplary embodiment is an image forming apparatus which is provided with the transfer roller according to the exemplary embodiment. Specifically, the image forming apparatus according to the exemplary embodiment includes an image carrier, a charging unit that charges the image carrier, and a latent image forming unit that forms a latent image on the charged image carrier, a developing unit that develops the latent image formed on a surface of the image carrier with a toner to form a toner image, and a transfer unit that includes the transfer roller according to the exemplary embodiment and transfers the toner image formed on the surface of the image carrier to the recording medium.

The transfer unit may be configured to include a single transfer roller which directly transfers an image to the recording medium, or may be configured to include an intermediate transfer body to Which a toner image formed on a surface of an image carrier, a primary transfer roller which transfers the toner image formed on the surface of the image carrier to the surface of the intermediate transfer body, and a secondary transfer roller which transfers the toner image which is transferred to the surface of the intermediate transfer body to the recording medium.

The direct transfer type transfer unit is provided with the transfer roller according to the exemplary embodiment as the transfer roller disposed to face the image carrier.

In addition, the intermediate transfer type transfer unit is provided with the transfer roller according to the exemplary embodiment as the transfer roller of at least one of the primary transfer roller and the secondary transfer roller.

As the image thrilling apparatus according to the exemplary embodiment, for example, a general mono-color image forming apparatus Which accommodates only a single color toner in the developing device, an image forming apparatus which directly transfers the toner image held on the image carrier to the recording medium, a color image forming apparatus which repeatedly performs the primary transfer for the toner image formed on the image carrier to the intermediate transfer body in order, and a tandem-type color image forming apparatus in which plural image carriers each of which is provided with a developing device for each color are arranged on the intermediate transfer body in series.

The process cartridge according to the exemplary embodiment which is detachable to the image forming apparatus includes the transfer roller according to the exemplary embodiment, and the transfer unit that transfers the toner image formed on the surface of the image carrier to the recording medium. In addition, the process cartridge according to the exemplary embodiment may include at least one, as necessary, selected from an image carrier, a charging unit that charges the image carrier, a latent image forming unit that forms a latent image on the surface of the charged image carrier, and a developing unit that develops the latent image formed on the surface of the image carrier with a toner to form a toner image.

Figure 4:
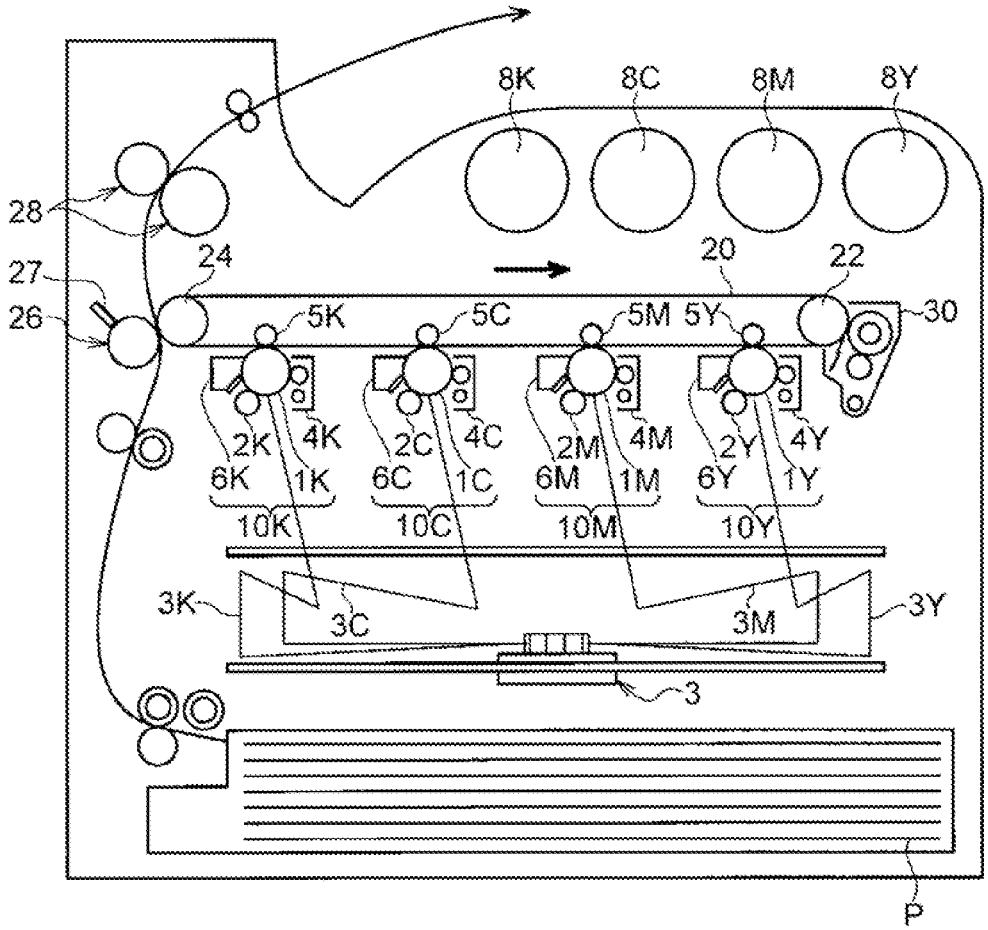
FIG. 4 is a schematic configuration diagram illustrating an example of an image forming apparatus according to the exemplary embodiment.

Hereinafter, the image forming apparatus according to the exemplary embodiment will be described with reference to the drawings. FIG. 4 is a schematic configuration diagram illustrating the image forming apparatus according to the exemplary embodiment.

The image forming apparatus illustrated in FIG. 4 is provided with first to fourth image forming units 10Y, 10M, 10C, and 10K obtained by using the electrophotographic system of outputting the image for each color of yellow (Y), magenta (M), cyan (C), and black (K) based on color-separated image data. The image forming units (hereinafter, simply referred to as "units") 10Y, 10M, 10C, and 10K are arranged side by side with a particular distance apart from each other in a horizontal direction. These units 10Y, 10M, 10C, and 10K may be a process cartridge which is detachably attached to the image forming apparatus main body.

In FIG. 4, as an intermediate transfer body, an intermediate transfer belt 20 is disposed through each of the units on the upper side of the units 10Y, 10M, 10C, and 10K. The intermediate transfer belt 20 configures the transfer unit for the image forming apparatus in the following manner. That is, the intermediate transfer belt 20 is wound on a supporting roller 24 which in contact with a driving roller 22 and the inner surface of the intermediate transfer belt 20 with being given tension. The driving roller 22 and the intermediate transfer belt 20 are separately disposed from each other in the direction from the right side to the left side in FIG. 4. The intermediate transfer belt 20 travels in the direction from the first unit 10Y to the fourth unit 10K.

The supporting roller 24 is urged by a spring or the like (not shown) in the direction separated from the driving roller 22, and a specific tension is applied to the intermediate transfer belt 20 which is wound around the driving roller 22 and the supporting roller 24. In addition, an intermediate transfer body cleaning device 30 is provided so as to face the driving roller 22 on the surface of the intermediate transfer belt 20 on the image carrier side.

In addition, the developing devices (developing units) 4Y, 4M, 4C, and 4K for the units 10Y, 10M, 10C, and 10K are capable of respectively supplying toners having four colors such as yellow, magenta, cyan, and black which are respectively accommodated in toner cartridges 8Y, 8M, C, and 8K.

Since the aforementioned first to fourth units 10Y, 10M, 10C, and 10K have the same configuration as each other, in the following description, the first unit 10Y that forms a yellow image disposed on the upstream side in the travel direction of the intermediate transfer belt will be representatively described. Like portions as those of the first unit 10Y are denoted by reference numerals of magenta (M), cyan (C), and black (K) instead of yellow (Y), and descriptions for the second to fourth units 10M, 10C, and 10K will be omitted.

The first unit 10Y includes a photoreceptor 1Y which serves as the image carrier. A charging roller 2Y that charges the surface of the photoreceptor 1Y to a specific potential, an exposure device 3 that forms an electrostatic charge image by exposing the charged surface to a laser beam 3Y based on color-separated image signal, a developing device 4Y (developing unit) that develops the electrostatic charge image by supplying the charged toner to the electrostatic charge image, a primary transfer roller 5Y (primary transfer unit) that transfers the developed toner image to the surface of the intermediate transfer belt 20, and a photoreceptor cleaning device 6Y (cleaning unit) that removes the toner remaining on the surface of the photoreceptor 1Y after performing the primary transfer by using a cleaning blade are sequentially disposed around the photoreceptor 1Y.

The primary transfer roller 5Y is disposed on the inside of the intermediate transfer belt 20, and is positioned so as to face the photoreceptor 1Y. Further, a bias supply (not shown) for applying a primary transfer bias is connected to each of the primary transfer rollers 5Y, 5M, 5C, and 5K. The each of the bias supplies is controlled by a controller (not shown to change the transfer bias which is applied to each of the primary transfer rollers.

Hereinafter, an operation of forming a yellow image in the first unit 10Y will be described. First, before the operation, the surface of the photoreceptor 1Y is charged to a potential in a range of −600 V to −800 V by the charging roller 2Y.

The photoreceptor 1Y is formed by stacking the photosensitive layers on the conductive substrate (the volume resistivity at 20° C.: equal to or less than $1\times10^6$ Ωcm). The aforementioned photosensitive layer typically has high resistance (resistance of a typical resin); however, when being irradiated with the laser beam 3Y, specific resistance of a portion which is irradiated with the laser beam is changed. Here, in accordance with the image data for yellow which is sent from the controller (not shown), the laser beam 3Y is output to the surface of the charged photoreceptor 1Y via the exposure device 3. The photosensitive layer of the surface of the photoreceptor 1Y is irradiated with the laser beam 3Y, and thus an electrostatic charge image having a yellow printed pattern is formed on the surface of the photoreceptor 1Y.

The electrostatic charge image is an image formed on the surface of the photoreceptor by charging, which is a so-called negative latent image which is formed in such a manner that the specific resistance of a portion of the photosensitive layer which is irradiated with the laser beam 3Y is decreased, and charges which are charged to the surface of the photoreceptor 1Y flow, or charges of a portion which is not irradiated with the laser beam 3Y remain on the surface.

The electrostatic charge image which is formed on the photoreceptor 1Y as described above is rotated along with the travel of the photoreceptor 1Y to a specific developing position. In addition, the electrostatic charge image on the photoreceptor 1Y is visualized (developed) at the developing position by the developing device 4Y.

A yellow toner is accommodated in the developing device 4Y, for example. The yellow toner is frictionally charged by being agitated in the developing device 4Y, and is held on the developer roller (developer holding member) with charges having the same polarity (negative polarity) as that of electrostatic charges which are charged onto the photoreceptor 1Y, In addition, when the surface of the photoreceptor 1Y passes through the developing device 4Y, the yellow toner is electrostatically attached to the erased latent image portion on the surface of the photoreceptor 1Y, and the latent image is developed by the yellow toner. The photoreceptor 1Y on which the yellow toner image is formed is continuously traveled at a specific speed, and the toner image developed on the photoreceptor 1Y is transported to a specific primary transfer position.

When the yellow toner image on the photoreceptor 1Y is transported to a primary transfer unit, a specific primary transfer bias is applied to the primary transfer roller 5Y, an electrostatic force toward the primary transfer roller 5Y from the photoreceptor 1Y acts on the toner image, and thus the toner image on the photoreceptor 1Y is transferred to the surface of the intermediate transfer belt 20. In this case, the applied transfer bias has a positive polarity which is opposite to a negative polarity of the toner, and is controlled to be +10 μA by the controller (not shown) in the first unit 10Y, for example.

On the other hand, the toner remaining on the photoreceptor 1Y is removed and collected by the cleaning device 6Y.

In addition, the primary transfer bias which is applied to the respective primary transfer rollers 5M, 5C, and 5K after the second unit 10M is also controlled based on the first unit.

As such, the toner images for the respective colors are sequentially transported through the second to fourth units 10M, 10C, and 10K, and are overlapped each other and multi-transferred to the intermediate transfer belt 20 to which the yellow toner image is transferred in the first unit 10Y.

The intermediate transfer belt 20 to which four toner images are multi-transferred through the first to fourth units travels to a secondary transfer unit including the intermediate transfer belt 20, the supporting roller 24 which is in contact with the inner surface of the intermediate transfer belt 20, and the secondary transfer roller 26 (the second transfer unit) which is disposed on the image holding surface side of the intermediate transfer belt 20. Meanwhile, a cleaning member 27 for the secondary transfer roller which is formed of an elastic material is in contact with the outer circumferential surface of the secondary transfer roller 26, and the toner which is attached to the outer circumferential surface of the secondary transfer roller 26 without being transferred to the recording medium P from the intermediate transfer belt 20 is removed.

On the other hand, the recording medium P is supplied to a gap, in which the secondary transfer roller 26 and the intermediate transfer belt 20 are in contact with each other, via a supply mechanism at a specific timing, and then the specific secondary transfer bias is applied to the supporting roller 24. At this time, the applied transfer bias has a negative polarity which is the same as the negative polarity of the toner, and the electrostatic force toward the recording medium P from the intermediate transfer belt 20 acts on the toner image, and thus the toner image on the intermediate transfer belt 20 is transferred onto the recording medium P. At this time, the secondary transfer bias is determined in accordance with the resistance detected by a resistance detection unit (not shown) that detects the resistance of the secondary transfer unit, and is voltage-controlled.

After that, the recording medium P is transported to a fixing device 28 (fixing unit), and the toner image is fixed onto the recording medium P by being heated so as to melt the toner images having overlapped colors. A series of color image forming operation is finished by transporting the recording medium P onto which the color images are fixed to an output portion.

The image forming apparatus described above is configured such that the toner image is transferred to the recording medium P via the intermediate transfer belt 20; however, the image forming apparatus according to the exemplary embodiment is not limited to the aforementioned configuration, and may have a structure in which the toner image is directly transferred to the recording medium P from the photoreceptor.

EXAMPLES

Hereinafter, the exemplary embodiment will be specifically described with reference to examples, and the exemplary embodiment is not limited to the following examples. In the following description, "part" indicates a weight basis unless otherwise specified.

Example 1

Crown-Shaped Foaming Elastic Layer+Crown-Shaped Polyimide Tube

Manufacturing of Foaming Elastic Layer

As an ion conductive roller, a urethane layer which is obtained by polymerizing isocyanate and polyol is molded in a roll shape, and the molded urethane layer is vulcanized and foamed by heat such that a urethane foam layer of φ30 mm is molded on a metal shaft of φ12 mm. As a foaming agent, benzene sulfonyl hydrazide is used. After that, by performing a polishing process on the outer circumferential surface of the urethane foam layer, a crown-shaped foaming elastic layer (the length in the axial direction: 210 mm) in which has the outer diameter of the both end portions is φ28 mm, and the outer diameter of the center portion is greater than the outer diameter of the both end portions by 100 μm is manufactured.

Manufacturing of Polyimide Tube

A solvent-soluble polyimide resin: manufactured by Toyobo Co. Ltd.: VYLOMAX HR16NN (solid content: 18% by weight, and solvent: methyl-2-pyrrolidone) is used as a polyimide resin for forming a surface layer, 25 parts by weight of carbon black as a conductive agent is added with respect to 100 parts by weight of the resin component, and dispersion is performed by using a disperser, thereby obtaining a coating liquid A.

A coating liquid B is obtained by adding and dispersing polytetrafluoroethylene (PTFE, solid content: 5% by weight) to a material containing the same components as those contained in the coating liquid A.

The outer surface of an aluminum pipe of the outer diameter which, is φ28 mm is coated with the coating liquid B, dried, and sintered sty as to form a layer having a thickness of 70 μm, and then, in the same way, the formed layer is coated with the coating liquid A, dried, and sintered, and thereby a polyimide tube having a total thickness of 100 μm is manufactured. The obtained polyimide tube is formed into a shape (crown shape) in which the outer diameter of the both end portions in the roller axial direction is 27.9 mm, and the outer diameter of the center portion is greater than the outer diameter of the both end portions in the roller axial direction by 100 μm.

The foaming elastic layer formed on the metal shaft is inserted into the polyimide tube which is manufactured as described above. With this, a transfer roller having a two-layer structure in which the outer circumferential, surface of the crown-shaped foaming elastic layer is covered with the crown-shaped polyimide tube (the surface resin layer) is obtained.

Example 2

Straight-Shaped Foaming Elastic Layer+Crown-Shaped Polyimide Tube

Manufacturing of Foaming Elastic Layer

As an ion conductive roller, a urethane layer which is obtained by polymerizing isocyanate and polyol is molded in a roll shape, and the molded urethane layer is vulcanized and foamed by heat such that a urethane foam layer of φ30 mm is molded on a metal shaft of φ12 mm. After that, by performing a polishing process on the outer circumferential surface of the urethane foam layer, a straight-shaped foaming elastic layer (the length in the axial direction: 210 mm) having the outer diameter which is φ28 mm is manufactured.

Manufacturing of Polyimide Tube

A solvent-soluble polyimide resin: manufactured by Toyobo Co., Ltd.: VYLOMAX HR16NN (solid content: 18% by weight, and solvent: methyl-2-pyrrolidone) is used as a polyimide resin for forming a surface layer, 25 parts by weight of carbon black as a conductive agent is added with respect to 100 parts by weight of the resin component, and dispersion is performed by using a disperser, thereby obtaining a coating liquid A.

A coating liquid B is obtained by adding and dispersing PTFE (solid content: 5% by weight) to a material containing the same components as those contained in the coating liquid A.

The outer surface of an aluminum pipe of the outer diameter which is φ28 mm is coated with the coating liquid B, dried, and sintered so as to form a layer having a thickness of 70 μm, and then, in the same way, the formed layer is coated with the coating liquid A, dried, and sintered, and thereby a polyimide tube having a total thickness of 100 μm is manufactured. The obtained polyimide tube is formed into such a shape (crown shape) that the outer diameter of the both end portions in the roller axial direction is 27.9 mm, and the outer diameter of the center portion is greater than the outer diameter of the both end portions in the roller axial direction by 100 μm.

The foaming elastic layer formed on the metal shaft is inserted into the polyimide tube which is manufactured as described above. With this, a transfer roller having a two-layer structure in which the outer circumferential surface of the straight-shaped foaming elastic layer is covered with the crown-shaped polyimide tube (the surface resin layer) is obtained.

Comparative Example 1

Straight-Shaped Foaming Elastic Layer+Straight-Shaped Polyimide Tube

Manufacturing of Foaming Elastic Layer

As an ion conductive roller, a urethane layer which is obtained by polymerizing isocyanate and polyol is molded in a roll shape, and the molded, urethane layer is vulcanized and foamed such that a urethane foam layer of φ30 mm is molded on a metal shaft of φ12 mm. After that, by performing a polishing process on the outer circumferential surface of the urethane foam layer, a straight-shaped foaming elastic layer having the outer diameter which is φ28 mm is manufactured.

Manufacturing of Polyimide Tube

A solvent-soluble polyimide resin: manufactured by Toyobo Co., Ltd.: VYLOMAX HR16NN (solid content: 18% by weight, and solvent: methyl-2-pyrrolidone) is used as a polyimide resin for forming a surface layer, 25 parts by weight of carbon black as a conductive agent is added with respect to 100 parts by weight of the resin component, and dispersion is performed by using a disperser, thereby obtaining a coating liquid.

The outer surface of an aluminum pipe of the outer diameter which is φ28 mm is coated with the obtained coating liquid, dried, and sintered, and thereby a straight-shaped polyimide tube (φ28 mm) having a thickness of 100 μm is manufactured.

The foaming elastic layer formed on the metal shaft i.s inserted into the polyimide tube which is manufactured as described above. With this, a transfer roller having a two layer structure in which the outer circumferential surface of the straight-shaped foaming elastic layer is covered with the straight-shaped polyimide tube (the surface resin layer) is obtained.

Reference Example 1

As an ion conductive roller, a urethane layer which is obtained by polymerizing isocyanate and polyol is molded in a roll shape, and the molded urethane layer is vulcanized and foamed such that a urethane foam layer of φ30 mm is molded on a metal shaft of φ12 mm. After that, by performing a polishing process on the outer circumferential surface of the urethane foam layer, a crown-shaped foaming elastic layer in which the outer diameter of the both end portions is φ28 mm, and the outer diameter of the center portion is greater than the outer diameter of the both end portions by 100 μm is manufactured. The obtained crown-shaped foaming elastic layer is set as the transfer roller.

Evaluation

As the secondary transfer roller, the transfer roller manufactured in each of the above-described examples is equipped with a modified machine of DocuCentre-II C6500 (image forming apparatus manufactured by Fuji Xerox Co. Ltd).

The evaluation of the image quality of transfer unevenness (density unevenness) and cleaning defect (dirt on the back side of the sheet) at the initial stage and after printing 3,000,000 copies under the normal temperature (22° C., 55% RH) is performed by using the aforementioned image forming apparatus.

Transfer Unevenness

As the secondary transfer roller, the transfer roller manufactured in each of the above-described examples is equipped with a modified machine of DocuCentre-II C6500 (image forming apparatus manufactured by Fuji Xerox Co. Ltd).

With such an image forming apparatus, the evaluation of the density unevenness in the roller axial direction is performed by performing the printing with the image quality concentration having 30% of the black concentration by using an A4-sized sheet as a recording medium. Regarding ten copies of images (initial images) and 3,000,000 copies of images (time series image), the density unevenness is visually confirmed based on sensory evaluation so as to perform the evaluation as follows.

A: density unevenness is not confirmed in the roller axial direction

B: density unevenness is slightly confirmed, but is not almost confirmed by eyes C: density unevenness is visually confirmed Cleaning Defect The sheet which is evaluated for transfer unevenness is evaluated for dirt (dirt on the back side of the sheet) by the toner on the back side of the sheet. An evaluation index is as follows.

A: toner dirt is not nearly generated on back side of sheet

B: toner dirt is slightly generated on back side of sheet, but is not visually recognizable C: toner dirt is generated on back side of sheet.

The main configuration of the foaming elastic layer (the urethane foam layer) and the surface resin layer (the polyimide tube) of the transfer roller manufactured in the respective examples, and the evaluation result thereof is indicated in Table 1.

TABLE 1

| | | Surface resin layer | | | | Initial images | | Time series image | |
|---|---|---|---|---|---|---|---|---|---|
| | Foaming elastic layer Shape | Resin component and thickness of inside | Resin component and thickness of outside | Shape | Outer diameter difference ΔD (μm) between center portion and end portions | Density unevenness in axial direction | Dirt on Back side of sheet | Density unevenness in axial direction | Dirt on back side of sheet |
| Example 1 | Crown | Polyimide + PTFE 70 μm | Polyimide 30 μm | Crown | 100 | A | A | A | A |
| Example 2 | Straight | Polyimide + PTFE 70 μm | Polyimide 30 μm | Crown | 100 | B | A | B | A |
| Comparative example 1 | Straight | Polyimide 100 μm | | Straight | 0 | C | A | C | A |
| Reference example 1 | Crown | None | | | — | A | B | A | C |

As indicated in Table 1, as compared with comparative examples, the density unevenness is prevented from occurrinng in the axial direction in the examples. The density unevenness is also prevented from occurring in the axial direction in Reference example 1; however, it is considered that the crown-shaped foaming elastic layer is not covered with the polyimide tube, and the cleaning by the blade is not sufficient performed, and thus the toner attached on the outer circumferential surface of the foaming elastic layer is attached again on the back surface of the sheet, thereby causing the dirt on the back side of the sheet.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A transfer roller comprising:

a support body;

a foaming elastic layer that is disposed on an outer circumferential surface of the support body; and a surface resin layer that contains polyimide or polyamide-imide and covers an outer circumferential surface of the foaming elastic layer, wherein:

circumferential lengths of both end portions of the surface resin layer in an axial direction of the transfer roller are shorter than a circumferential length of a center portion of the surface resin layer in the axial direction of the transfer roller, and the surface resin layer comprises two layers each formed from a different precursor solution, the different precursor solutions having different shrinkage rates from each other.

2. The transfer roller according to claim 1, wherein an outer diameter of a center portion of the foaming elastic layer in the axial direction of the transfer roller is larger than outer diameters of both end portions of the foaming elastic layer in the axial direction of the transfer roller.

3. An image forming apparatus comprising:

an image carrier;

a charging unit that charges the image carrier;

a latent image forming unit that forms a latent image on a surface of the charged image carrier;

a developing unit that develops the latent image formed on the surface of the image carrier with a toner to form a toner image; and a transfer unit that includes the transfer roller according to claim 1, and transfers the toner image formed on the surface of the image carrier to a recording medium.

4. The transfer roller according to claim 1, wherein the two layers of the surface resin layer include an outer layer and an inner layer, and the outer layer is formed from a precursor solution having a smaller shrinkage rate than a precursor solution from which the inner layer is formed.

* * * * *